US010305236B2

(12) United States Patent
De Gier et al.

(10) Patent No.: US 10,305,236 B2
(45) Date of Patent: May 28, 2019

(54) TRACK BASED LIGHTING AND INSTALLATION METHOD

(71) Applicant: SIGNIFY HOLDING B.V., Eindhoven (NL)

(72) Inventors: Ronald Cornelis De Gier, Eindhoven (NL); Rafal Moro, Eindhoven (NL); Karol Orlowski, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/560,768

(22) PCT Filed: Mar. 14, 2016

(86) PCT No.: PCT/EP2016/055436
§ 371 (c)(1),
(2) Date: Sep. 22, 2017

(87) PCT Pub. No.: WO2016/150741
PCT Pub. Date: Sep. 29, 2016

(65) Prior Publication Data

US 2018/0102617 A1 Apr. 12, 2018

(30) Foreign Application Priority Data

Mar. 26, 2015 (EP) ..... 15161045

(51) Int. Cl.

| | |
|---|---|
| ***F21V 17/00*** | (2006.01) |
| ***H01R 25/14*** | (2006.01) |
| ***F21V 21/002*** | (2006.01) |
| ***F21V 21/35*** | (2006.01) |

(52) U.S. Cl.
CPC ..... *H01R 25/145* (2013.01); *F21V 21/002* (2013.01); *F21V 21/35* (2013.01); *H01R 25/14* (2013.01)

(58) Field of Classification Search
CPC ..... F21V 21/002; F21V 21/35; H01R 25/145; H01R 25/14
USPC ..... 362/648
See application file for complete search history.

(56) References Cited

U.S. PATENT DOCUMENTS

| | | | | | |
|---|---|---|---|---|---|
| 2,332,766 | A * | 10/1943 | Von Gehr | H01R 25/14 | 191/1 R |
| 3,251,382 | A * | 5/1966 | Tatsch | F16L 9/003 | 138/151 |
| 3,295,556 | A * | 1/1967 | Gertsma | F16L 11/121 | 138/119 |
| 3,818,948 | A * | 6/1974 | Hedges | C07C 405/00 | 138/119 |
| 4,655,520 | A * | 4/1987 | Cummings | F21V 21/002 | 439/111 |

(Continued)

FOREIGN PATENT DOCUMENTS

| | | | | |
|---|---|---|---|---|
| EP | 2458296 A1 * | 5/2012 | B32B 5/022 | |
| GB | 2362351 A * | 11/2001 | B65D 11/1893 | |

*Primary Examiner* — Claude J Brown

(57) ABSTRACT

A lighting track support structure comprises a base section and opposing side sections. These sections are rollable for transportation in a roll. This means the length of the structure (when unrolled) may be longer than would be able to be transported in a straight configuration. This reduces (or eliminates) the need for connectors between multiple sections. This therefore reduces the time and cost of installing the lighting track.

13 Claims, 5 Drawing Sheets

(56) References Cited

U.S. PATENT DOCUMENTS

| | | | | | |
|---|---|---|---|---|---|
| 5,259,774 | A * | 11/1993 | Gabrius | F21V 21/35 | 439/110 |
| 6,059,582 | A * | 5/2000 | Tsai | H01R 25/142 | 362/287 |
| 9,618,144 | B2 * | 4/2017 | Wallin | F24F 13/0245 | |
| 9,840,050 | B2 * | 12/2017 | Lanciaux | B29D 23/001 | |
| 2005/0236172 | A1 * | 10/2005 | Bushey | H02G 3/0425 | 174/481 |
| 2009/0284988 | A1 * | 11/2009 | Snagel | F21S 8/038 | 362/648 |
| 2009/0296381 | A1 * | 12/2009 | Dubord | F21S 2/005 | 362/218 |

* cited by examiner

TRACK BASED LIGHTING AND INSTALLATION METHOD

CROSS-REFERENCE TO PRIOR APPLICATIONS

This application is the U.S. National Phase application under 35 U.S.C. § 371 of International Application No. PCT/EP2016/055436, filed on Mar. 14, 2016 which claims the benefit of European Patent Application No. 15161045.8, filed on Mar. 26, 2015. These applications are hereby incorporated by reference herein.

FIELD OF THE INVENTION

The invention relates to track based lighting systems.

BACKGROUND OF THE INVENTION

In both retail and industrial lighting applications, track based systems are often used create linear lighting systems. The track is defined by trunking, which creates a mechanical and electrical infrastructure to which lighting fixtures can be mounted at desired locations.

This provides a flexible lighting system, which can be configured according to the lighting requirements at different areas within the retail or industrial space.

The lines may have a significant length, of many meters, or even tens of meters. For large warehouses or other buildings, there may be lighting tracking having a length up to 200 meters or more.

The current way to install this kind of electrical and mechanical infrastructure is by using segments of preformed steel or aluminum. Typically, the segments have a maximum length of 4.5 meters, mainly limited by the transportation requirements, since the segments need to fit in a truck or minivan, and also possibly in elevators in buildings.

By using segments, many pieces need to be coupled together, both mechanically and electrically. This causes a lot of work and cost, and the demands on the coupling pieces are high to create and maintain a straight line.

SUMMARY OF THE INVENTION

The invention is defined by the claims.

According to examples in accordance with an aspect of the invention, there is provided a lighting track support structure, comprising a base section and opposing side sections, wherein the structure is transformable from an open state into an assembled state, in the open state the structure is rollable for transportation in a roll, and in the assembled state the structure is a rigid channel.

This means the length of the structure (when unrolled) may be longer than would be able to be transported in a straight configuration. This reduces (or eliminates) the need for connectors between multiple sections. This therefore reduces the time and cost of installing the lighting track. The installation has a low number of operations, a low number of components, with low space and weight and therefore low transportation costs. The length can easily be adjusted (by cutting) either on site or before transportation. By the transformation of the structure from its open state into the assembled state, the flat, essentially 2 dimensional form factor of the structure in its open state, which enables the structure to be rollable then, changes into a voluminous, essentially 3 dimensional channel which renders the structure to be rigid and in a non-rollable state. The channel then can be considered to form the trunk or housing of the lighting track/system. Rigid in this context means that the structure is essentially incapable of or relatively highly resistant to bending and/or deformation, and preferably is self-supporting over distances of, for example at least 0.75 meter, 2.5 meter or 4 meter. The rigidity of the structure renders the structure capable of being suspended in free space and/or act as such, hence without the need for a separate or additional housing or carrier, as a support/mounting structure for lighting units, for example spot light lamps, mounting or removal of said lighting units can easily be done via the front side of the channel.

In a first set of examples, each side section is pivotally mounted to the base section such that in the open state the base section and the opposing side sections lie in a common plane, and in the closed state the base section and the opposing side sections define the channel.

In the open state, the three sections may be rolled as a single entity. This keeps the installation task as simple as possible. It also means the base section and the opposing side sections may be formed as a single component.

Each opposing side section may comprise a first lock feature which engages with a corresponding second lock feature of the base section to lock the structure in the closed state. The structure is thus simply folded from a flat profile to the channel profile, and it locks itself in place. In the channel profile, the structure gains rigidity and thus resists bending or rolling. This means it is easy to install in long lengths. It may be supported at periodic intervals, for example each 1 meter, 2 meter or 5 meter, to maintain a desired straight path when installed.

In a second set of examples, each side section and the base section are separate elements, adapted to be rolled separately, and coupled together in an unrolled state. This reduces the size of the parts when being transported, although additional assembly is required on site.

When coupled together, the base section and the opposing side sections define a channel.

In a most basic implementation, only a supporting frame is rolled. Wires or conductor sheets with other non-circular cross sections may be separately rolled and fitted to the support frame (for example as a push fit into suitable channels) at the installation site, to create the required electrical interconnects. However, it is preferred that the structure includes the required conductors to form the electrical tracks for connection to lighting modules.

The structure thus preferably further comprises electrical conductors mounted to the opposing side sections, wherein the side section electrical conductors are rollable in situ.

The side section electrical conductors may for example comprise wires which run along the length of the side section, each retained at the base of a retaining channel. Lighting modules may connect to these wires to draw power and also to receive control commands.

One or more electrical conductors may also be mounted to the base section, wherein the base section electrical conductor or conductors are rollable in situ.

The base section electrical conductor or conductors may for example comprise a ground wire which runs along the length of the base section and which projects beyond the surface of the base section. This means the ground connection may be the first connection made when a lighting module is attached, and the last to be broken when a lighting module is detached.

As explained above, long lengths are enabled. For example, the length of the side sections and the base sections is at least 10 m. It may be much longer, for example many tens of meters.

The invention includes the structure when in its rolled configuration for transportation and/or storage as well as when in its unrolled and channel states.

The invention also provides a lighting system comprising the structure as defined above in its unrolled and channel state and one or more lighting units electrically and mechanically fitted to the channel defined by the side sections and the base section.

According to examples in accordance with another aspect of the invention, there is provided a method of installing a lighting track support structure which comprises a base section and opposing side sections, the method comprising:

receiving the structure in a rolled up, open state;

unrolling the base section and the opposing side sections;

forming an assembled, rigid channel from the base section and the opposing side sections; and installing the rigid channel.

In a method of installing a lighting system, the lighting track support structure is installed using the method above, and lighting units are fitted to the channel.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting track support structure which comprises a base section and opposing side sections. These sections are rollable for transportation in a roll. This means the length of the structure (when unrolled) may be longer than would be able to be transported in a straight configuration. This reduces (or eliminates) the need for connectors between multiple sections. This therefore reduces the time and cost of installing the lighting track.

Figure 1:
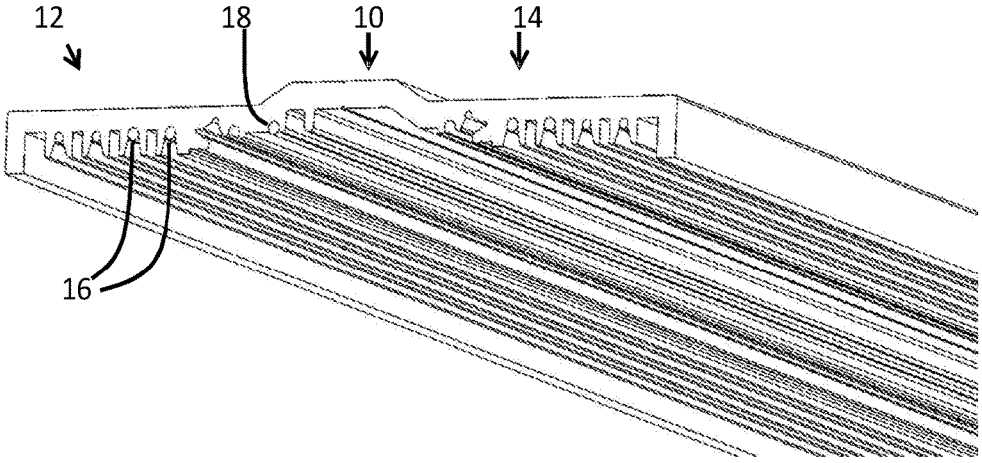
FIG. 1 shows a first example of lighting support structure in the open rollable state.

FIG. 1 shows a first example of lighting track support structure, which comprises a support frame and electrical conductors carried by the support frame.

The structure comprises a base section 10 and opposing side sections 12, 14. FIG. 1 shows the side sections oriented in an open shape so that the complete structure forms a substantially flat web. The overall shape is generally planar, although there are surface features for example for retaining electrical conductors 16 in the side wall, and optionally also one or more electrical conductor 18 in the base section. The complete structure can be rolled up into a coil. FIG. 1 shows the width, i.e. a cross section perpendicular to the length direction. The length is much greater than the width, and the rolling is along the length direction.

This example has the base and side sections permanently connected together, but each side section is pivotally mounted to the base section such that the track has the open state of FIG. 1, and an assembled state in which the base section and the opposing side sections are in a closed configuration to define a channel. The side sections are perpendicular to the base in the channel configuration, thereby forming a U-shape.

Figure 2:
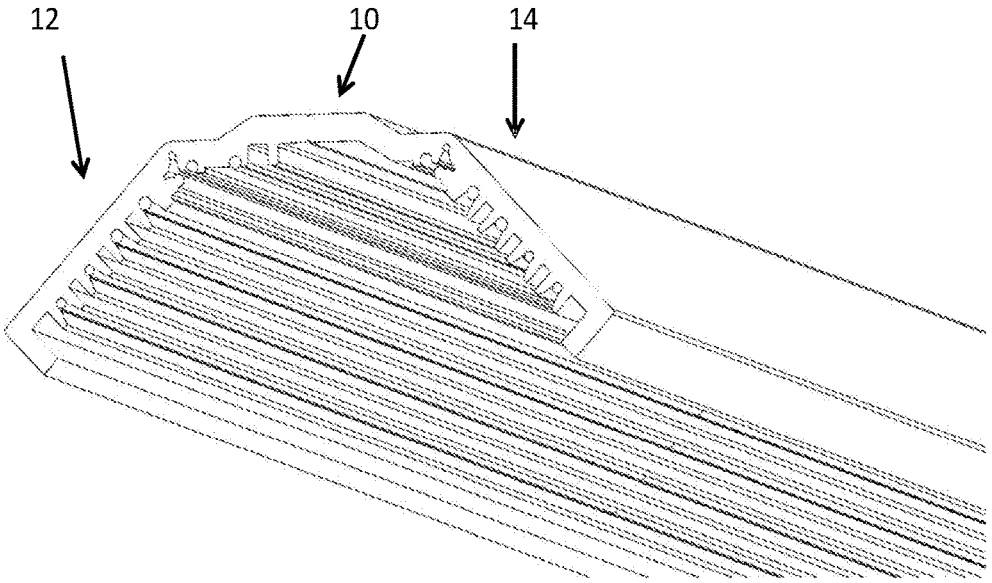
FIG. 2 shows the structure of FIG. 1 in a partially closed state.

FIG. 2 shows the side sections 12, 14 being bent or pivoted downwardly towards the channel configuration.

Figure 3:
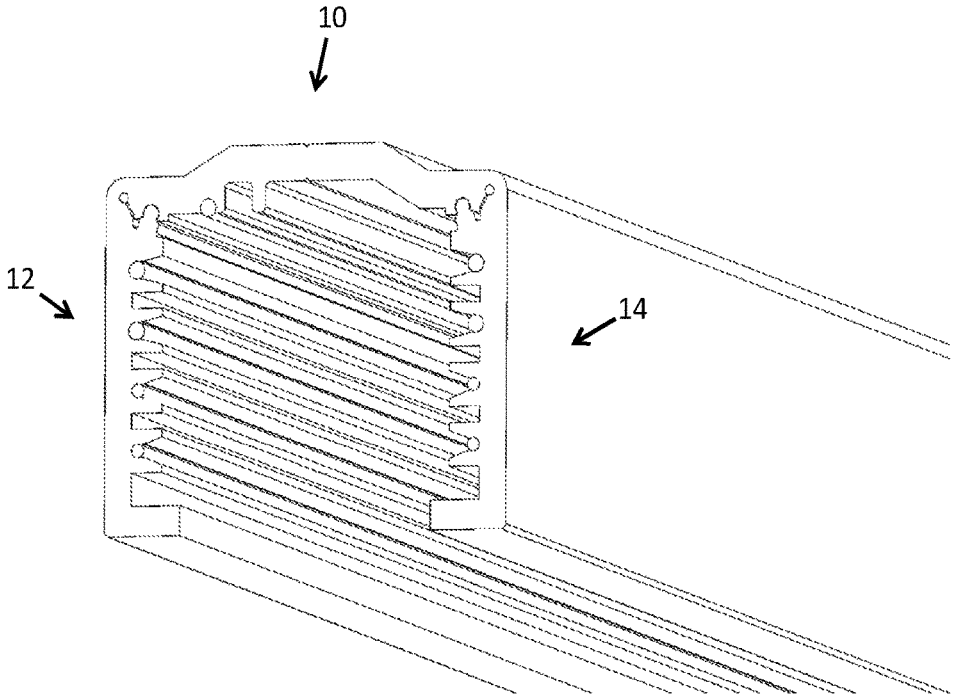
FIG. 3 shows the structure of FIG. 1 in the fully closed, assembled channel-forming state.

FIG. 3 shows the channel fully formed. The side sections 12, 14 lock with the base section when the channel is fully formed.

Figure 4:
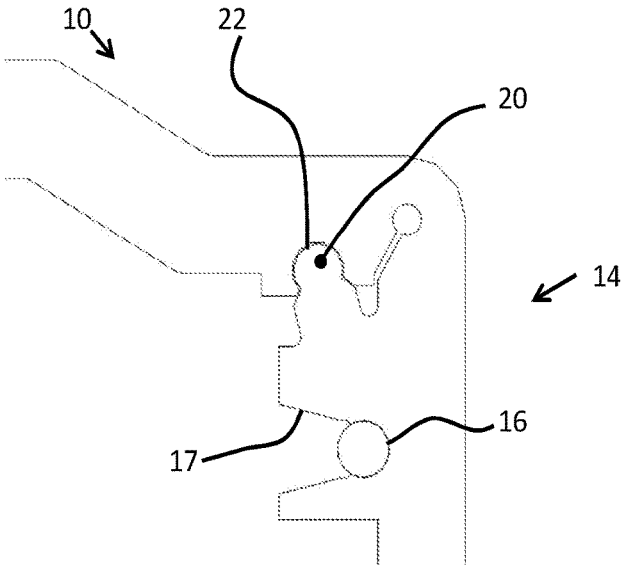
FIG. 4 shows a locking arrangement of the structure of FIG. 1 in more detail.

FIG. 4 shows the locking arrangement in more detail, for one side section (the same system is on both sides). The side section has a first lock feature in the form of a projecting ball 20, which engages with a corresponding second lock feature of the base section in the form of a socket 22. When the ball and socket engage, the structure is locked in the assembled channel configuration.

Of course, any other locking feature may be used.

FIG. 4 also shows one wire 16 in more detail, retained at the base of a channel 17.

The structure is thus simply folded from a flat profile to the channel profile, and it locks itself in place. In the channel profile, the structure gains rigidity and thus resists bending or rolling. This means it is easy to install in long lengths. It may be supported at periodic intervals to maintain a desired straight path when installed.

Figure 5:
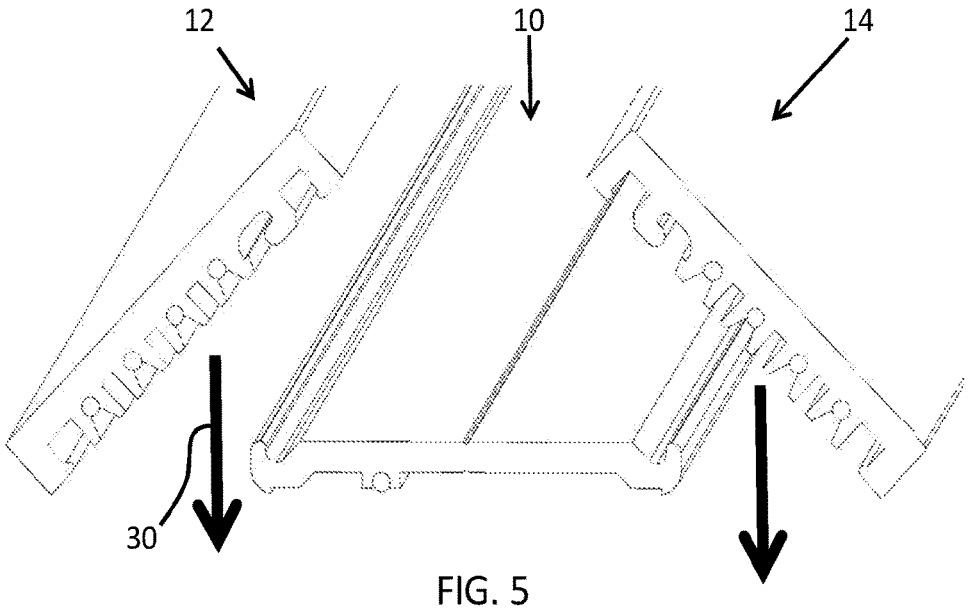
FIG. 5 shows a second example of lighting support structure in the open rollable state.

FIG. 5 shows a second example in which each side section 12, 14 and the base section 10 are separate elements, adapted to be rolled separately, and to be coupled together on site in the unrolled state by integrated coupling parts, a push and twist coupling as shown in FIG. 5, but alternatively said coupling parts may be, for example, a male-female snap coupling or a length-wise sliding coupling. This reduces the size of the parts when being transported, although additional assembly is required on site.

When coupled together, the base section and the opposing side sections again define a rigid channel.

Figure 6:
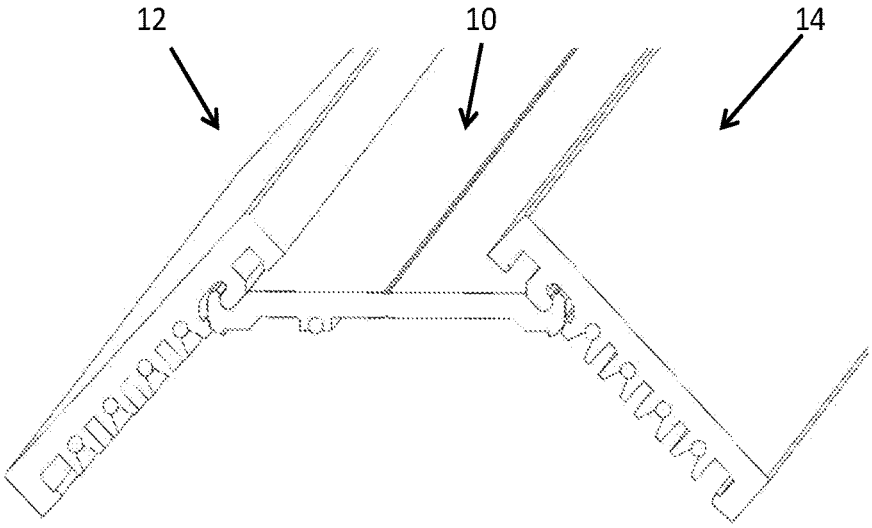
FIG. 6 shows the structure of FIG. 5 in a partially closed state.

FIG. 5 shows the three separate sections after being unrolled. This example makes use of a push and twist coupling to join the sections together. Each side section is first pushed onto a channel of the base section as shown by arrows 30, with the side sections inclined but not perpendicular to the base. Once engaged, as shown in FIG. 6, the sides can be pivoted down to engage fully.

Figure 7:
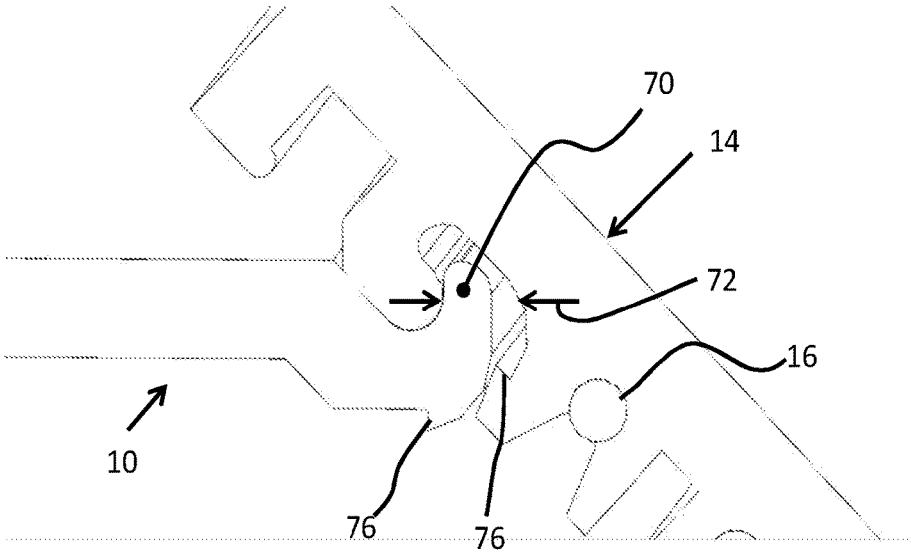
FIG. 7 shows a locking arrangement of the structure of FIG. 5 in more detail.
Figure 8:
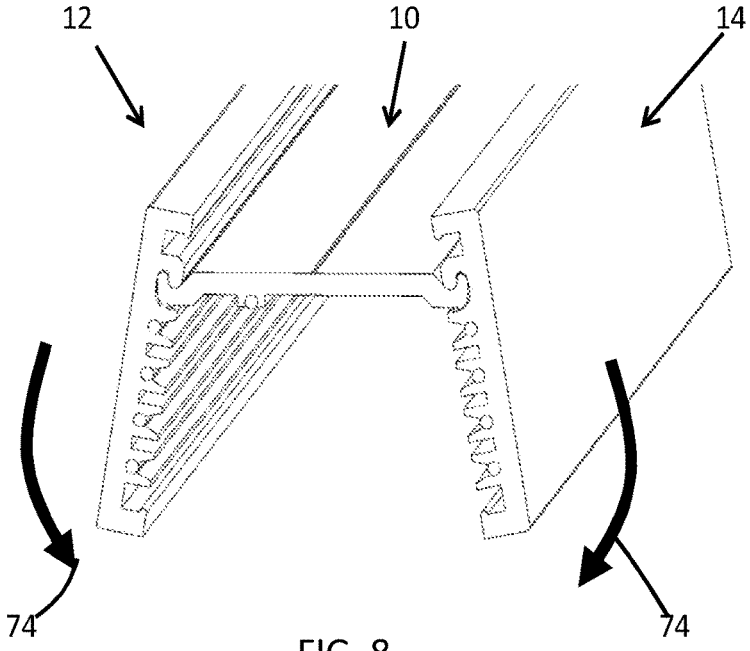
FIG. 8 shows the structure of FIG. 5 approaching the fully closed, assembled channel-forming state.

The coupling is shown in more detail in FIG. 7 for one side (the coupling works the same way on the other side). The base section 10 has an upwardly extending lip 70 which is received in a channel opening 72 of the side section 14. Once received, the side section can be rotated as shown by arrows 74 in FIG. 8. This causes a snap fit retainer to engage, comprising engaging barbs 76.

Of course, other coupling designs may be used.

The structure is thus clipped together to form the channel profile, and it locks itself in place. In the channel profile, the structure again has rigidity and thus resists bending or rolling. This means it is again easy to install in long lengths.

It may be supported at periodic intervals to maintain a desired straight path when installed.

In a most basic implementation only a supporting frame is rolled. Wires may be separately rolled and fitted to the support frame (for example as a push fit into wiring channels) at the installation site, to create the required electrical interconnects. However, it is preferred that the structure includes the required conductors to form the electrical tracks for connection to lighting modules.

Figure 9:
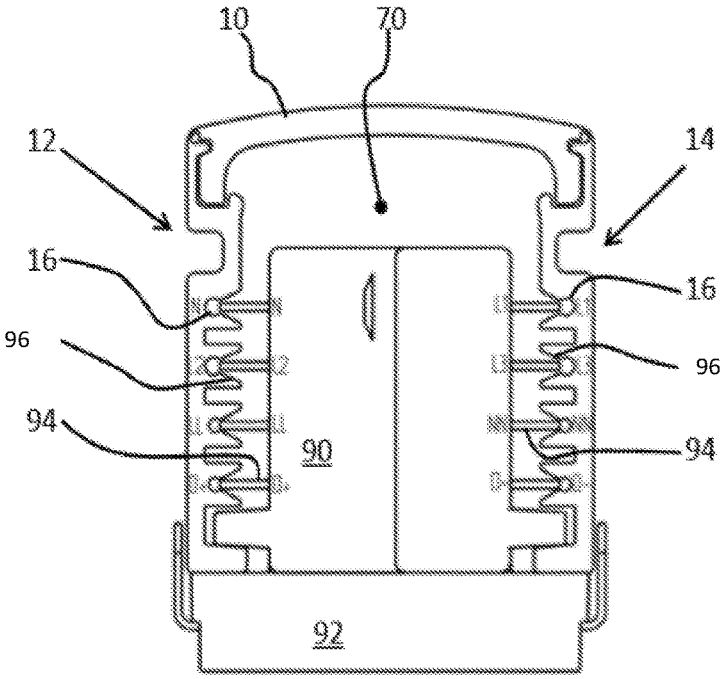
FIG. 9 shows a lighting module fitted to the channel.

FIG. 9 shows the support structure in more detail with a fitted lighting module. The conductor wires 16 are clipped in place at the base of respective channels 96 so that a portion of the wire 16 is exposed to enable electrical contact to be made.

FIG. 9 shows a lighting module fitted in the channel. The lighting module has an adapter part 90 and a light output part 92. The adapter part 90 has projecting connector pins 94 which make contact with the wires 16. In this way, the adapter part receives power and control signals from the wires 16, and powers and controls the light output part 92.

FIG. 9 shows a 9-pole supply and communication system for the connected lighting units or other modules. These 9 poles comprise earth, neutral, three live phases, two poles for emergency and two poles for communication.

The wires are designed to meet relevant standards, such as the IEC60570 standards for track based luminaires.

The wires may simply comprise circular cross section cables, as shown, but they may instead comprise surface metallization or an elongate conducting inserts with a more profiled cross section.

Any known conductor design used in trunk lighting may be employed, providing it can be designed to be rollable.

Figure 10:
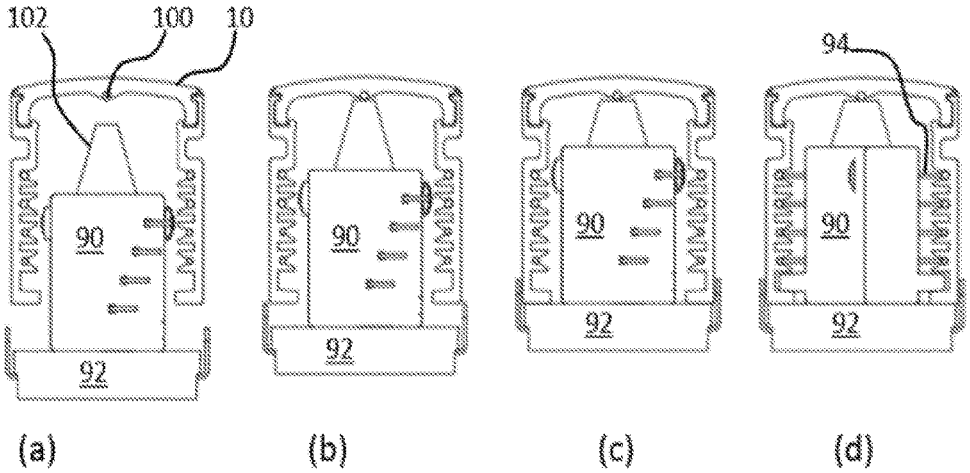
FIG. 10 shows how the lighting module is fitted into the channel as sequential steps.

FIG. 10 shows how a lighting module is connected into the channel formed by the lighting track support structure.

The lighting module 90, 92 is fitted by pushing into place then twisting the adapter part 90.

FIG. 10(*a*) shows the module 90,92 brought up to the channel.

FIG. 10(*b*) shows that before electrical connection to the side sections is made, a ground connection is made.

For this purpose, the base section 10 has a protruding ground wire 100 (equivalent to the conductor 18 shown in some of the figures above) which is contacted by a spring loaded contact 102 of the lighting module before the lighting module is fully inserted into the channel. The ground connection is then the first connection made when a lighting module is attached, and the spring coupling means it is the last broken connection when removing the module.

The module 90, 92 is then fully inserted as shown in FIG. 10(*c*).

Finally, the adapter part 90 is then twisted, for example through 90 degrees about a vertical axis, to bring the contact pins 94 into contact with the wires of the side walls. This is shown in FIG. 10(*d*).

The module is then electrically and mechanically fitted to the channel.

As explained above, long lengths are enabled. For example, the length of the side sections and the base sections is at least 10 m. It may be much longer, for example many tens of meters, and even up to 100 m or more.

The material used for the support structure will be selected to be sufficiently flexible to be rolled up but sufficiently rigid to form a straight channel. There will be a lower limit to the bending radius in the rolled state, and a compromise will be found between the minimum bending radius (i.e. how tightly it can be rolled) and the rigidity obtained in the channel configuration.

The main support is for example a plastics material. A suitable plastic material is sufficiently flexible to be rolled up. Furthermore, it may be produced by an extrusion or co-extrusion process, as one automatic process without the need for post-processing and finishing.

The material may be formed as a composite material, for example an outer thin aluminum sheet and an inner plastics body which defines the locking system for the corners and the channels for the conductors. With a sufficiently thin aluminum covering, the overall structure can still be coiled but there is an increase in stiffness. This structure may comprise a lamination of an aluminum foil and the extruded plastic part, as part of the same overall manufacturing process. The aluminum (or other metal) outer housing may also function as an electrical earth contact.

The conductors 16 and 18 are typically copper.

The channel formed needs a size suitable to fit the adapter, which includes drivers and other modules, such as emergency modules and batteries.

Emergency modules are used in lighting systems for switching the power supply from the external power supply to an internal emergency battery power supply, and for charging emergency batteries. The batteries are used for powering of the light source when the building power supply is interrupted.

By way of example, the width of the channel may be in the range 25 mm to 50 mm and the depth may be in the range 35 mm to 70 mm.

To install the structure, it is transported and received on site in the rolled up configuration. The base section and the opposing side sections are then unrolled (either separately or as a single unit) before the channel is formed by the folding operation. The channel is then installed, for example suspended from a ceiling or formed as an integral part of a ceiling. The lighting units are then fitted to the channel. It may be supported every 2.5 m for example to maintain the channel straight.

The channel may receive modules in addition to lighting units.

The power provided to the conductors may be low or high voltage, and it may be ac or dc.

In the examples above, the lighting track support structure has either a one-piece or a three-piece design. Another possibility is a two-piece structure, for example each piece comprising a side section and half of the base section. The two pieces have fold regions in the same way as described above so that the half base section and the side section can be folded from a flat configuration in which the piece can be rolled up to the channel configuration. The two pieces then have features to enable the two base halves to be coupled together.

These features may be identical. For example, a sequence of interlocking tabs and recesses may be provided, or an alternating arrangement of other locking features. This enables the two pieces to be made to the same design, so that there is only one type of component, but it can be smaller than the one-piece design. If the overall design starts at one end with a first type of locking feature and ends with a second type of locking feature, two identical pieces can be mated together facing each other, with the first and second locking features engaging with each other.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting track support structure, comprising a base section and opposing side sections, wherein the structure is transformable from an open state into an assembled state, in the open state the structure is rollable for transportation in a roll, and in the assembled state the structure is a rigid channel, wherein the base section and the opposing side sections are formed as a single component, and wherein each opposing side section comprises a first lock feature which engages with a corresponding second lock feature of the base section to lock the structure in the assembled state.

2. A structure as claimed in claim 1, wherein each side section is pivotally mounted to the base section such that in the open state the base section and the opposing side sections lie in a common plane, and in the assembled state the base section and the opposing side sections define the channel.

3. A structure as claimed in claim 1, further comprising electrical conductors mounted to the opposing side sections, wherein the side section electrical conductors are rollable in situ.

4. A structure as claimed in claim 3, wherein the side section electrical conductors comprise wires which run along the length of the side section, each retained at the base of a retaining channel.

5. A structure as claimed in claim 1, further comprising one or more electrical conductors mounted to the base section, wherein the base section electrical conductor or conductors are rollable in situ.

6. A structure as claimed in claim 5, wherein the base section electrical conductor or conductors comprise a ground wire which runs along the length of the base section and which projects beyond the surface of the base section.

7. A structure as claimed in claim 1, wherein the length of the side sections and the base sections is at least 10 m.

8. A structure as claimed in claim 1, in a rolled configuration for transportation and/or storage.

9. A lighting system comprises a structure as claimed in claim 1 in its unrolled configuration and one or more lighting units electrically and mechanically fitted to a channel defined by the side sections and the base section.

10. A lighting track support structure, comprising a base section and opposing side sections, wherein the structure is transformable from an open state into an assembled state, in the open state the structure is rollable for transportation in a roll, and in the assembled state the structure is a rigid channel, wherein each side section and the base section are separate elements, adapted to be rolled separately, and coupled together via mutually cooperating integrated coupling parts in the base and side sections, to assume the assembled, unrolled state.

11. A structure as claimed in claim 10, wherein when coupled together, the base section and the opposing side sections define the channel.

12. A method of installing a lighting track support structure which comprises a base section and opposing side sections, the method comprising:

receiving the structure in a rolled up, open state;

unrolling the base section and the opposing side sections;

forming an assembled state, rigid channel from the base section and the opposing side sections;

installing the rigid channel, and locking, with a first lock feature, each opposing side section, by engaging a corresponding second lock feature of the base section to lock the structure in an assembled state.

13. A method of installing a lighting system, comprising:

installing a lighting track support structure using the method as claimed in claim 12; and fitting lighting units to the channel.

* * * * *